US009078071B2

(12) United States Patent
Katsumata

(10) Patent No.: US 9,078,071 B2
(45) Date of Patent: Jul. 7, 2015

(54) MOBILE ELECTRONIC DEVICE AND CONTROL METHOD

(75) Inventor: Tomoya Katsumata, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 421 days.

(21) Appl. No.: 13/557,393

(22) Filed: Jul. 25, 2012

(65) Prior Publication Data

US 2013/0028428 A1 Jan. 31, 2013

(30) Foreign Application Priority Data

Jul. 27, 2011 (JP) ..... 2011-164850

(51) Int. Cl.
*H04R 29/00* (2006.01)
*H04R 25/00* (2006.01)

(52) U.S. Cl.
CPC ..... *H04R 25/00* (2013.01); *H04R 29/00* (2013.01)

(58) Field of Classification Search
CPC ..... H03G 9/18; H04R 5/04; H04R 25/70; H04R 25/30; H04R 25/505; H04R 25/305; H04R 25/554; H04R 25/356; H04R 25/502
USPC ..... 381/60, 312, 317, 320, 321, 77, 104, 381/106, 107, 103
See application file for complete search history.

(56) References Cited

U.S. PATENT DOCUMENTS

2011/0044473 A1* 2/2011 Shon et al. ..... 381/104

FOREIGN PATENT DOCUMENTS

| | | | |
|---|---|---|---|
| JP | 2000209698 | A | 7/2000 |
| JP | 201028515 | A | 2/2010 |
| JP | 2010278856 | A | 12/2010 |

OTHER PUBLICATIONS

Office Action mailed Oct. 21, 2014, corresponding to Japanese patent application No. 2011-164850, for which an explanation of relevance is attached.

* cited by examiner

*Primary Examiner* — Vivian Chin
*Assistant Examiner* — David Ton
(74) *Attorney, Agent, or Firm* — Lowe Hauptman & Ham, LLP

(57) ABSTRACT

According to an aspect, a mobile electronic device includes a sound emitting unit, an input unit, and a processing unit. The sound emitting unit emits a sound based on a sound signal. The input unit receives a response with respect to the sound emitted by the sound emitting unit. The processing unit determines a compensation parameter for compensating the sound to be emitted by the sound emitting unit based on correctness of the response.

15 Claims, 11 Drawing Sheets

MOBILE ELECTRONIC DEVICE AND CONTROL METHOD

CROSS-REFERENCE TO RELATED APPLICATIONS

This application claims priority from Japanese Application No. 2011-164850, filed on Jul. 27, 2011, the content of which is incorporated by reference herein in its entirety.

BACKGROUND

1. Technical Field

The present disclosure relates to a mobile electronic device that outputs sound and a control method thereof.

2. Description of the Related Art

Mobile electronic devices such as a mobile phone and a mobile television device produce sound. Due to hearing loss resulting from aging or the other factors, some users of the mobile electronic devices feel difficulties in hearing the produced sound.

To address that problem, Japanese Patent Application Laid-Open No. 2000-209698 describes a mobile device with a sound compensating function for compensating the frequency characteristics and the level of sound produced from a receiver or the like according to age-related auditory change.

Hearing loss has various causes such as aging, disease, and exposure to noise, and has various degrees. Therefore, the sound may not be compensated enough for the users only by compensating the frequency characteristics and the level of sound produced from a receiver or the like according to the user's age as described in the above patent literature.

For the foregoing reasons, there is a need for a mobile electronic device and a control method that adequately compensates the sound to be output according to individual user's hearing ability to output the sound more easily heard by the user.

SUMMARY

According to an aspect, a mobile electronic device includes: a sound emitting unit for emitting a sound based on a sound signal; a sound generation unit for generating a presentation sound to be emitted by the sound emitting unit; an input unit for receiving input of a response with respect to the presentation sound emitted by the sound emitting unit; a timer for measuring time; a determining unit for determining a value with respect to correctness of the response; a parameter setting unit for setting a compensation parameter for compensating the sound signal based on the value determined by the determining unit; and a compensation unit for compensating the sound signal based on the compensation parameter and supplying the compensated sound signal to the sound emitting unit. The determining unit is configured to detect a response time from emission of the presentation sound to input of the response measured by the timer and to weight the value based on the response time.

According to another aspect, a mobile electronic device includes a sound emitting unit, an input unit, and a processing unit. The sound emitting unit emits a sound based on a sound signal. The input unit receives a response with respect to the sound emitted by the sound emitting unit. The processing unit determines a compensation parameter for compensating the sound to be emitted by the sound emitting unit based on correctness of the response.

According to another aspect, a control method for a mobile electronic device includes: emitting a sound based on a sound signal by a sound emitting unit; receiving a response with respect to the sound by an input unit; and determining a compensation parameter for compensating the sound to be emitted by the sound emitting unit based on correctness of the response.

DETAILED DESCRIPTION

Exemplary embodiments of the present invention will be explained in detail below with reference to the accompanying drawings. It should be noted that the present invention is not limited by the following explanation. In addition, this disclosure encompasses not only the components specifically described in the explanation below, but also those which would be apparent to persons ordinarily skilled in the art, upon reading this disclosure, as being interchangeable with or equivalent to the specifically described components.

In the following description, a mobile phone is used to explain as an example of the display device; however, the present invention is not limited to mobile phones. Therefore, the present invention can be applied to a variety of devices, including but not limited to personal handyphone systems (PHS), personal digital assistants (PDA), portable navigation units, personal computers (including but not limited to tablet computers, netbooks etc.), media players, portable electronic reading devices, and gaming devices.

Figure 1:
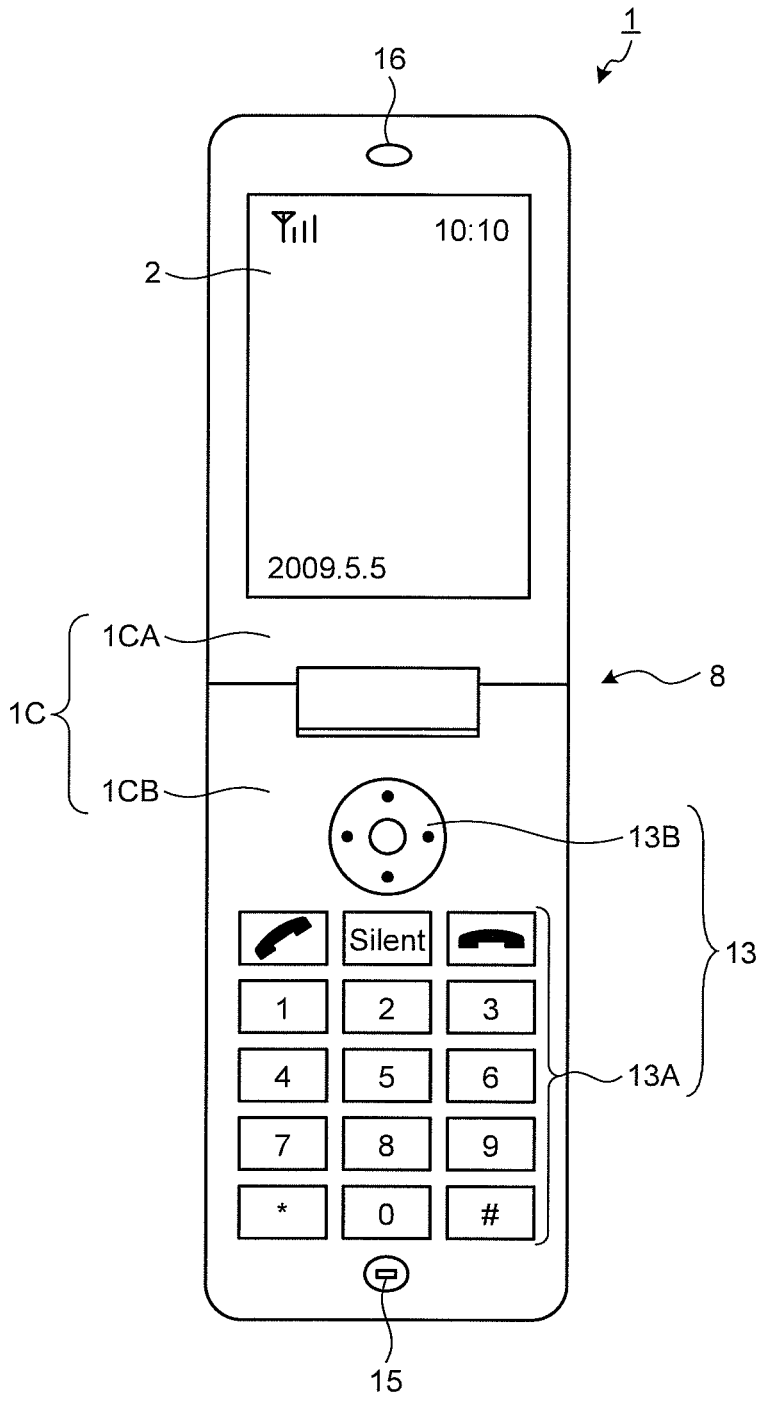
FIG. 1 is a front elevation view of a mobile electronic device according to an embodiment.
Figure 2:
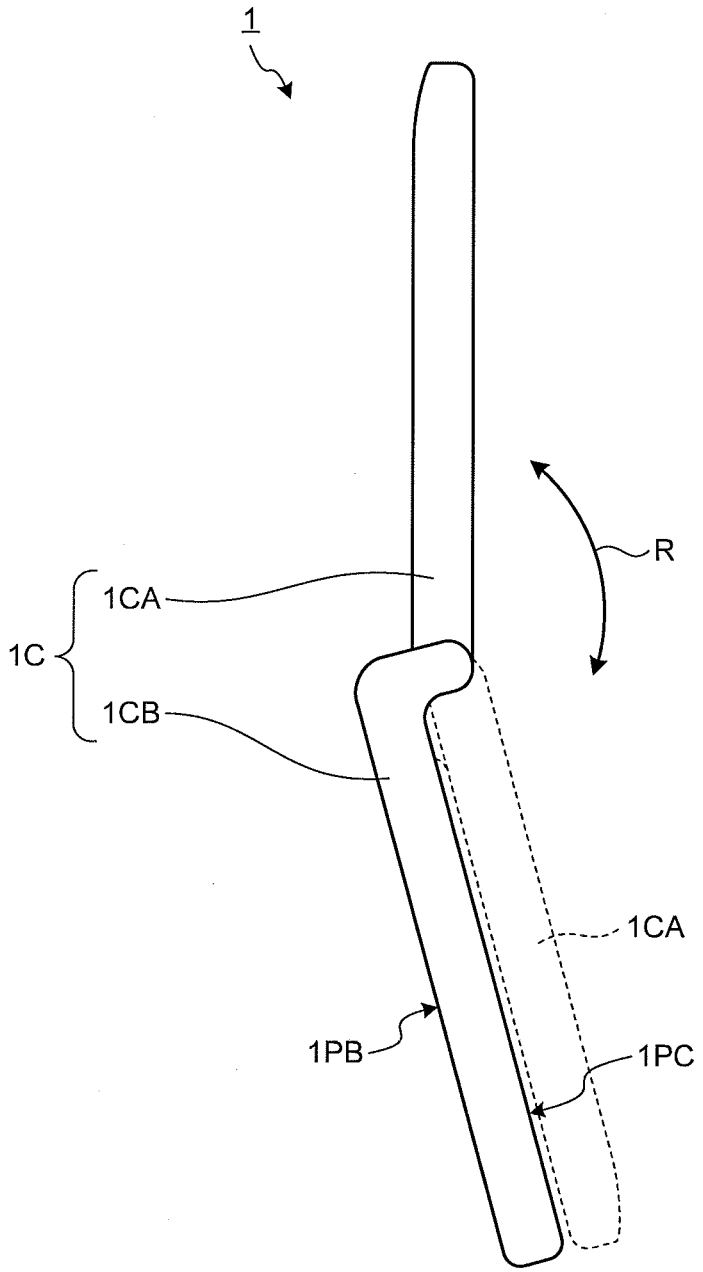
FIG. 2 is a side view of the mobile electronic device.

FIG. 1 is a front elevation view of a mobile electronic device according to an embodiment, and FIG. 2 is a side view of the mobile electronic device illustrated in FIG. 1. The mobile electronic device 1 illustrated in FIGS. 1 and 2 is a mobile phone including a wireless communication function, a sound output function, and a sound capture function. The mobile electronic device 1 has a housing 10 including a plurality of housings. Specifically, the housing 10 includes a first housing 1CA and a second housing 1CB which are configured to be opened and closed. That is, the mobile electronic device 1 has a foldable housing. However, the housing of the mobile electronic device 1 is not limited to that configuration. For example, the housing of the mobile electronic device 1 may be a sliding housing including two housings which are configured to slide on each other from the state where they are placed on each other, or may be a housing including two rotatable housings one of which is capable of rotating on an axis along the direction of placing the two housings, or may be a housing including two housings which are coupled to each other via a biaxial hinge. The mobile electronic device 1 may be a housing in the form of a thin plate.

The first housing 1CA and the second housing 1CB are coupled to each other by a hinge mechanism 8, which is a junction. Coupled with the hinge mechanism 8, the first housing 1CA and the second housing 1CB can rotate on the hinge mechanism 8 to be apart from each other and close each other (in the direction indicated by an arrow R of FIG. 2). When the first housing 1CA and the second housing 1CB rotate to be apart from each other, the mobile electronic device 1 opens, and when the first housing 1CA and the second housing 1CB rotate to be close each other, the mobile electronic device 1 closes to be in the folded state (the state illustrated by the dotted line of FIG. 2).

The first housing 1CA is provided with a display 2 illustrated in FIG. 1 as a display unit. The display 2 displays a standby image while the mobile electronic device 1 is waiting for receiving a call, and displays a menu screen which is used to support operations to the mobile electronic device 1. The first housing 1CA is provided with a receiver 16, which is an output section for outputting sound during a call or the like of the mobile electronic device 1.

The second housing 1CB is provided with a plurality of operation keys 13A for inputting a telephone number to call and characters in composing an email or the like, and a direction and decision keys 13B for facilitating selection and confirmation of a menu displayed on the display 2 and for facilitating the scrolling or the like of the screen. The operation keys 13A and the direction and decision keys 13B constitute the operating unit 13 of the mobile electronic device 1. The second housing 1CB is provided with a microphone 15, which is a sound capture section for capturing sound during a call of the mobile electronic device 1. The operating unit 13 is provided on an operation surface 1PC of the second housing 1CB illustrated in FIG. 2. The other side of the operation surface 1PC is the backside 1PB of the mobile electronic device 1.

Inside the second housing 1CB, an antenna is provided. The antenna, which is a transmitting and receiving antenna for use in the radio communication, is used in transmitting and receiving radio waves (electromagnetic waves) of a call, an email or the like between the mobile electronic device 1 and a base station. The second housing 1CB is provided with the microphone 15. The microphone 15 is placed on the operation surface 1PC side of the mobile electronic device 1 illustrated in FIG. 2.

Figure 3:
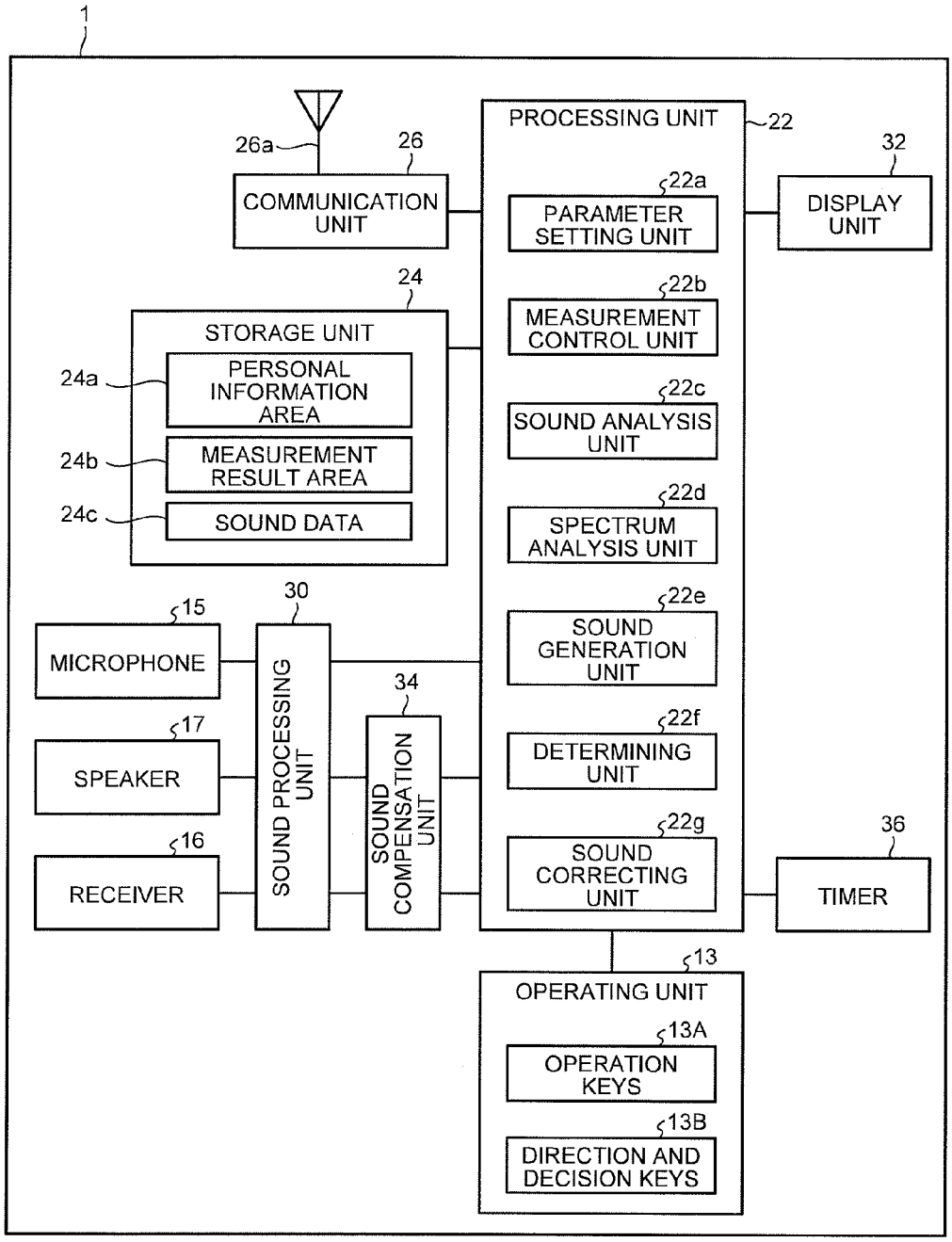
FIG. 3 is a block diagram of the mobile electronic device.

FIG. 3 is a block diagram of the mobile electronic device illustrated in FIGS. 1 and 2. As illustrated in FIG. 3, the mobile phone 1 includes a processing unit 22, a storage unit 24, a communication unit 26, an operating unit 13, a sound processing unit 30, a display unit 32, a sound compensation unit 34, and a timer 36. The processing unit 22 has a function of integrally controlling entire operations of the mobile electronic device 1. That is, the processing unit 22 controls operations of the communication unit 26, the sound processing unit 30, the display unit 32, the timer 36 and the like so that respective types of processing of the mobile electronic device 1 are performed in adequate procedures according to operations for the operating unit 13 and software stored in the storage unit 24 of the mobile electronic device 1.

The respective types of processing of the mobile electronic device 1 include, for example, a voice call performed over a circuit switched network, composing, transmitting and receiving an email, and browsing of a Web (World Wide Web) site on the Internet. The operations of the communication unit 26, the sound processing unit 30, the display unit 32 and the like include, for example, transmitting and receiving of a signal by the communication unit 26, input and output of sound by the sound processing unit 30, and displaying of an image by the display unit 32.

The processing unit 22 performs processing based on a program (for example, an operating system program, an application program or the like) stored in the storage unit 24. The processing unit 22 includes an MPU (Micro Processing Unit), for example, and performs the above described respective types of processing of the mobile electronic device 1 according to the procedure instructed by the software. That is, the processing unit 22 performs the processing by sequentially reading instruction codes from the operating system program, the application program or the like which is stored in the storage unit 24.

The processing unit 22 has a function of performing a plurality of application programs. The application programs performed by the processing unit 22 include a plurality of application programs, for example, an application program for reading and decoding various image files (image information) from the storage unit 24, and an application program for displaying an image obtained by decoding.

In the embodiment, the processing unit 22 includes a parameter setting unit 22*a* which sets a compensation parameter for the sound compensation unit 34, a measurement control unit 22*b* which controls respective measurement experiments set by the parameter setting unit 22*a*, a sound analysis unit 22*c* which performs voice recognition, a spectrum analysis unit 22*d* which performs spectrum analysis on sound, a sound generation unit 22*e* which generates a presentation sound (test sound), a determining unit 22*f* which determines a measurement (a detected result of a user's response) detected by each measurement experiment performed by the measurement control unit 22*b*, and a sound correction unit 22*g* which corrects the presentation sound generated by the sound generation unit 22*e*. The respective functions of the parameter setting unit 22*a*, the measurement control unit 22*b*, the sound analysis unit 22*c*, the spectrum analysis unit 22*d*, the sound generation unit 22*e*, the determining unit 22*f*, and the sound correction unit 22*g* are realized when hardware resources including the processing unit 22 and the storage unit 24 perform the tasks allocated by the controlling unit of the processing unit 22. The task refers to a unit of processing which cannot be performed simultaneously among the whole processing performed by application software or the processing performed by the same application software. The functions of the parameter setting unit 22*a*, the measurement control unit 22*b*, the sound analysis unit 22*c*, the spectrum analysis unit 22*d*, the sound generation unit 22*e*, the determining unit 22*f*, and the sound correction unit 22*g* may be performed by a server which can communicate with the mobile electronic device 1 via the communication unit 26 so that the server transmits the performed result to the mobile electronic device 1. The processing performed by the respective components of the processing unit 22 will be described later together with operations of the mobile electronic device 1.

The storage unit 24 stores software and data to be used for processing in the processing unit 22 and tasks for starting the above described image processing program. Other than these tasks, the storage unit 24 stores, for example, communicated and downloaded sound data, or software used by the processing unit 22 in controlling the storage unit 22, an address book in which telephone numbers, email address and the like of the contacts are described for management, sound files including a dial tone and a ring tone, and temporally data and the like to be used in software processing.

The storage unit 24 of the embodiment has a personal information area 24*a* and a measurement result area 24*b*, and stores sound data 24*c*. The personal information area 24*a* stores various types of information including a user profile, emails, a Web page access history and the like. The personal information area 24*a* may store only the link information to the other data stored in the storage unit 24. For example, the personal information area 24*a* may store information on addresses in a storage area for emails stored in a storage area related to an email function. The measurement result area 24*b* stores results of respective measurement experiments performed by the measurement control unit 22*b* and determinations performed by the determining unit 22*f*. The data accumulated in the measurement result area 24*b* is used by the parameter setting unit 22*a* in deciding a compensation parameter. The measurement result area 24*b* can also delete some of the accumulated data based on the processing by the processing unit 22. The sound data 24*c* contains many presentation sounds to be used in the respective measurement experiments. In the embodiment, the presentation sound is a sound to be heard by the user when a compensation parameter is set, and may be a word or a sentence.

A computer program and temporary data to be used in software processing are temporally stored in a work area allocated to the storage unit 24 by the processing unit 22. The storage unit 24 includes one or more non-transitory storage medium, for example, a nonvolatile memory (such as ROM, EPROM, flash card etc.) and/or a storage device (such as magnetic storage device, optical storage device, solid-state storage device etc.). The storage unit 24 may also include a storage device for storing temporary data, such as DRAM (Dynamic Random Access Memory) etc.

The communication unit 26 has an antenna 26*a* and establishes a wireless signal path using a code-division multiple access (CDMA) system, or any other wireless communication protocols, with a base station via a channel allocated by the base station, and performs telephone communication and information communication with the base station. Any other wired or wireless communication or network interfaces, e.g., LAN, Bluetooth, Wi-Fi, NFC (Near Field Communication) may also be included in lieu of or in addition to the communication unit 26. The operating unit 13 includes the operation keys 13A to which respective functions are allocated including a power source key, a call key, numeric keys, character keys, direction keys, a confirm key, a launch call key, and the direction and decision keys 13B. When the user operates these keys for input, a signal corresponding to the user's operation is generated. The generated signal is input to the processing unit 22 as the user's instruction. In addition to, or in place of, the operation keys 13A and the direction and decision keys 13B, the operating unit 13 may include a touch sensor laminated on the display unit 32. That is, the mobile electronic device 1 may be provided with a touch panel display which has both functions of the display unit 32 and the operating unit 13.

The sound processing unit 30 processes a sound signal input to the microphone 15 and a sound signal output from the receiver 16 or the speaker 17. That is, the sound processing unit 30 amplifies sound input from the microphone 15, performs AD conversion (Analog-to-Digital conversion) on it, and then further performs signal processing such as encoding or the like to convert it to digital sound data, and outputs the data to the processing unit 22. In addition, the sound processing unit 30 performs processing such as decoding, DA conversion (Digital-to-Analog conversion), amplification on signal data sent via the sound compensation unit 34 from the processing unit 22 to convert it to an analog sound signal, and outputs the signal to the receiver 16 or the speaker 17. The speaker 17, which is placed in the housing 10 of the mobile electronic device 1, outputs the ring tone, an email sent notification sound or the like.

The display unit 32, which has the above described display 2, displays a video according to video data and an image according to image data supplied from the processing unit 22. The display 2 includes, for example, an LCD (Liquid Crystal Display) or an OELD (Organic Electro-Luminescence Display). The display unit 32 may have a sub-display in addition to the display 2.

The sound compensation unit 34 performs compensation on sound data sent from the processing unit 22 based on a compensation parameter set by the processing unit 22 and outputs it to the sound processing unit 30. The compensation performed by the sound compensation unit 34 is the compensation of amplifying the input sound data with a different gain according to the volume and the frequency based on a compensation parameter. The sound compensation unit 34 may be implemented by a hardware circuit or by a CPU and a program. When the sound compensation unit 34 is implemented by a CPU and a program, the sound compensation unit 34 may be implemented inside the processing unit 22. The function of the sound compensation unit 34 may be performed by a server which can communicate with the mobile electronic device 1 via the communication unit 26 so that the server transmits the sound data which is subjected to the compensation processing to the mobile electronic device 1.

The timer 36 is a processing unit for measuring an elapse of time. Although the mobile electronic device 1 of the embodiment exemplifies a configuration having a timer for measuring an elapse of time independently of the processing unit 22, a timer function may be provided in the processing unit 22.

Figure 4:
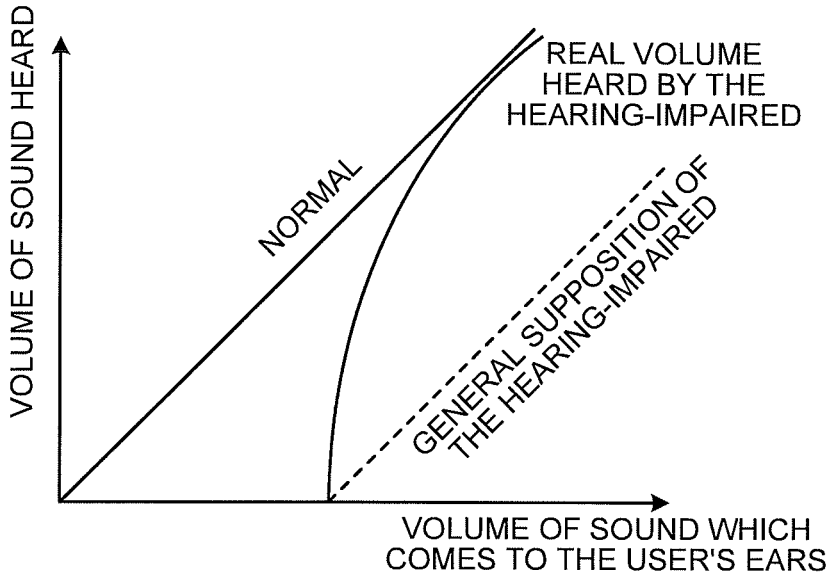
FIG. 4 is a diagram illustrating the frequency characteristics of the human hearing ability.
Figure 5:
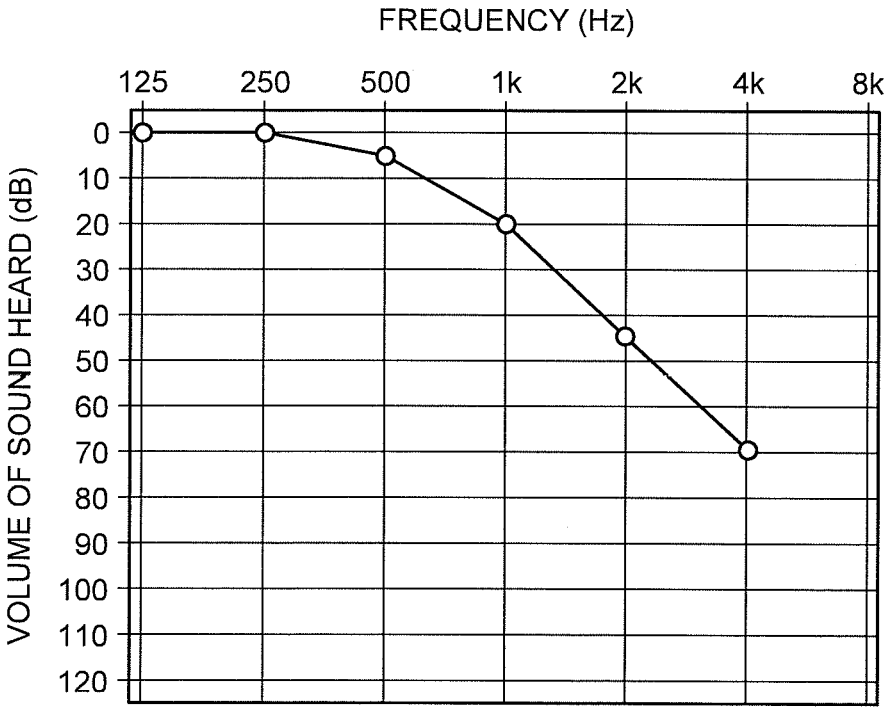
FIG. 5 is a diagram illustrating the frequency characteristics of the hearing ability of a hearing-impaired.
Figure 6:
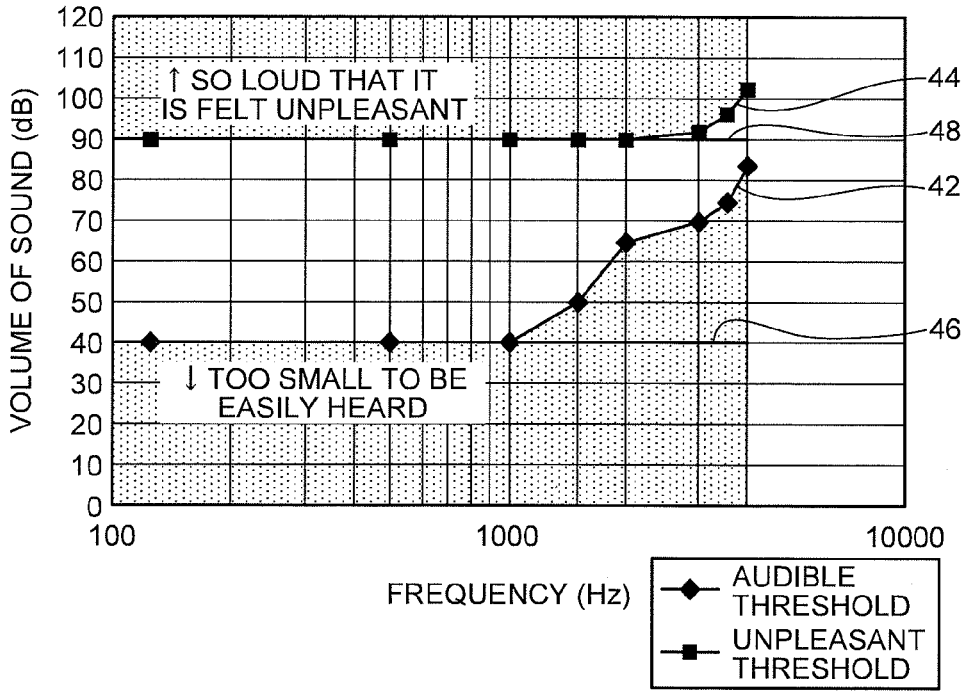
FIG. 6 is a diagram illustrating an example of an audible threshold and an unpleasant threshold.
Figure 7:
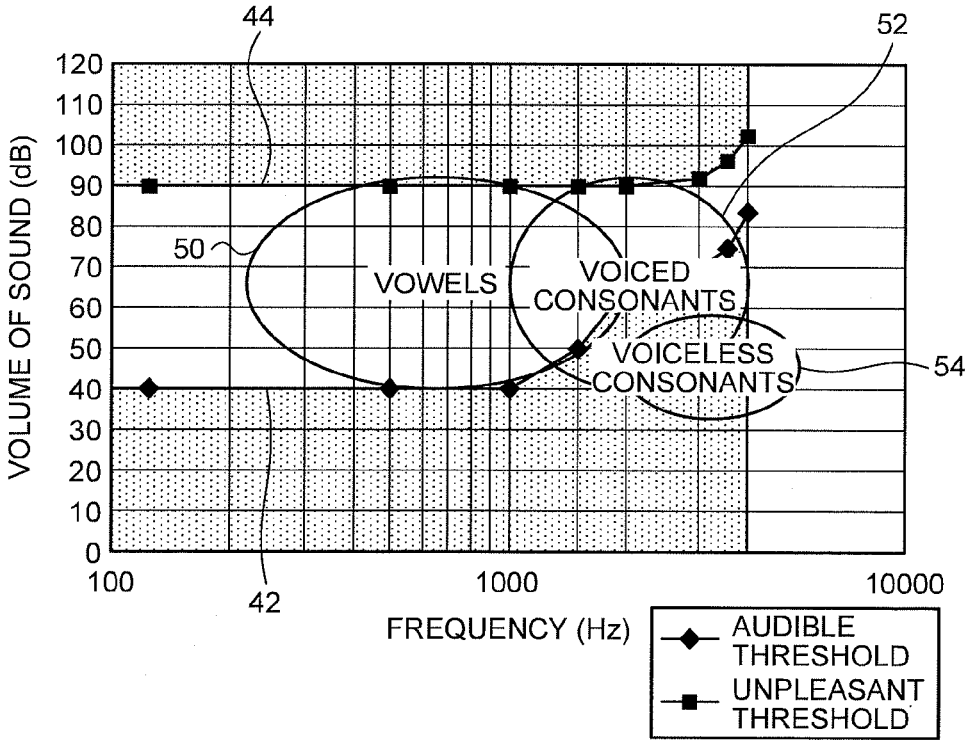
FIG. 7 is a diagram superimposing the volume and the frequencies of vowels, voiced consonants, and voiceless consonants on FIG. 6.
Figure 8:
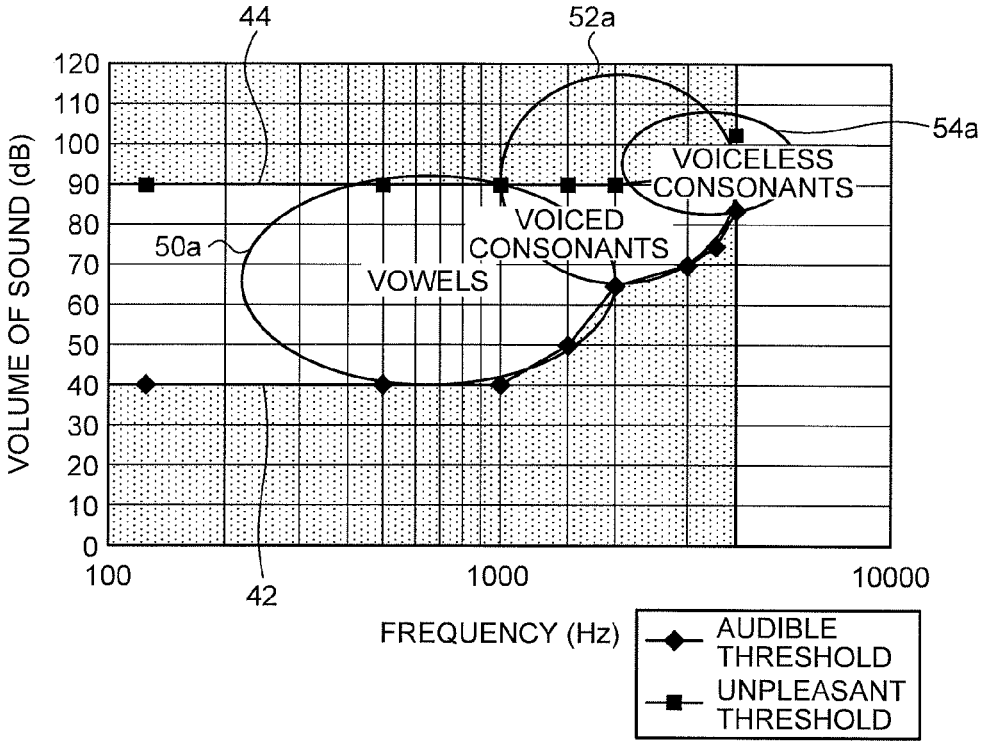
FIG. 8 is a diagram simply amplifying the high-pitched tones (consonants) illustrated in FIG. 7.
Figure 9:
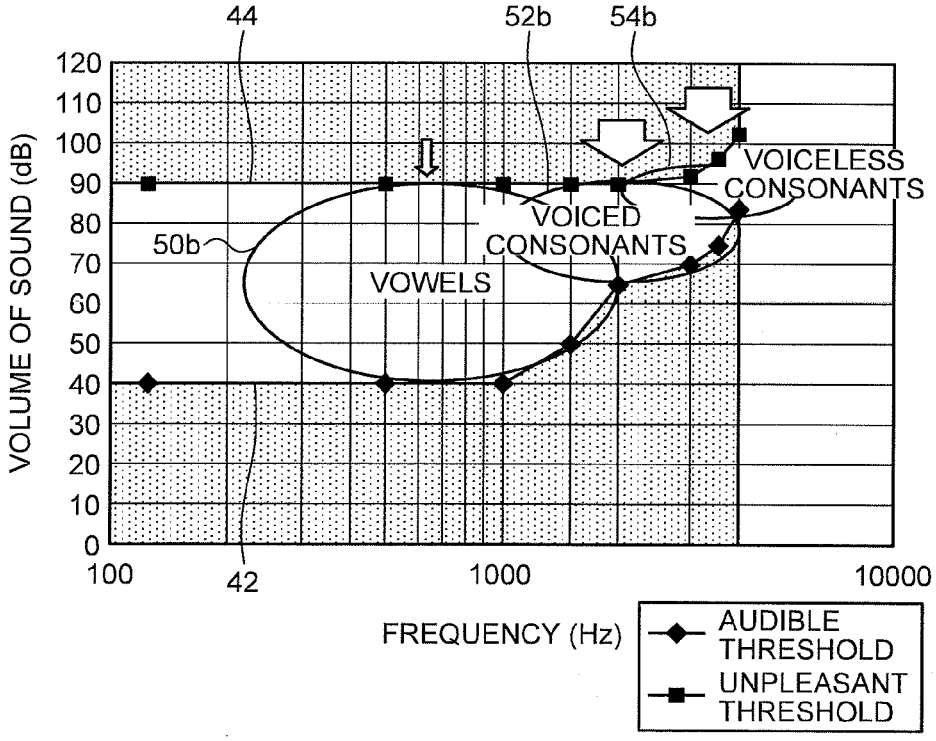
FIG. 9 is a diagram illustrating compressed sounds of loud volume illustrated in FIG. 8.

Then, the human hearing ability will be described with reference to FIGS. 4 to 9. FIG. 4 is a diagram illustrating the frequency characteristics of the human hearing ability. FIG. 5 is a diagram illustrating the frequency characteristics of the hearing ability of a hearing-impaired. FIG. 6 is a diagram illustrating an example of an audible threshold and an unpleasant threshold. FIG. 7 is a diagram superimposing the volume and the frequencies of vowels, voiced consonants, and voiceless consonants on FIG. 6. FIG. 8 is a diagram simply amplifying the high-pitched tones (consonants) illustrated in FIG. 7. FIG. 9 is a diagram illustrating compressed sounds of loud volume illustrated in FIG. 8.

FIG. 4 illustrates relationship between the volume of sound which comes to human being's ears and the volume of sound heard (sensed) by human being. For a person with normal hearing ability, the volume of sound which comes to the person's ears and the volume of sound heard (sensed) by the person are in proportion to each other. On the other hand, it is supposed that the hearing-impaired (an aged person, a patient with ear disease, and the like) can generally hear almost nothing until the volume of sound which comes to the person's ears reaches a certain value, and once the sound which comes to the person's ears is at the certain value or more, the person begins to hear the sound in proportion to the volume of sound which comes to the person's ears. Therefore, based on that general supposition, it is considered that it is only needed to simply amplify the sound which comes to the hearing-impaired. However, in reality, the hearing-impaired can hear almost nothing until the volume of sound which comes to the person's ears reaches a certain value, and once the sound which comes to the person's ears is at the certain value or more, the person suddenly begins to hear the sound as loud sound. For that reason, the hearing-impaired may hear a change by 10 dB as a change by 20 dB, for example. Therefore, compression processing (processing of reducing the gain to loud sound below the gain to small sound) needs to be performed on loud sound. FIG. 5 illustrates the frequency characteristics of the hearing ability of the hearing-impaired. As illustrated in FIG. 5, the hearing-impaired can hear a low-pitched sound well and can hear less as the sound becomes higher-pitched. The characteristics illustrated in FIG. 5 are merely an example and the frequency characteristics which can be heard differ for each user.

FIG. 6 illustrates an example of relationship between the volume of output sound and an audible threshold and an unpleasant threshold for a person with normal hearing ability and the hearing-impaired. The audible threshold refers to the minimum volume of sound which can be heard appropriately, for example, the sound which can be heard at 40 dB. Sound of the volume less than the audible threshold is sound too small to be easily heard. The unpleasant threshold refers to the maximum volume of sound which can be heard appropriately, for example, the sound which can be heard at 90 dB. Sound of the volume more than the unpleasant threshold is sound so loud that it is felt unpleasant. As illustrated in FIG. 6, for the hearing-impaired, both an audible threshold 42 and an unpleasant threshold 44 increase as the frequency increases. On the other hand, for a person with normal hearing ability, both the audible threshold 46 and the unpleasant threshold 48 are constant with respect to the volume of the output sound.

FIG. 7 is a diagram superimposing the volume and the frequencies of vowels, voiced consonants, and voiceless consonants which are output without adjustment on the relationship between the volume of output sound and the audible threshold and the unpleasant threshold for the hearing-impaired. As illustrated in FIG. 7, the vowels output without adjustment, i.e., the vowels output in the same condition as that used for the person with normal hearing ability are output as sound of the frequency and the volume in a range surrounded by a range 50. Similarly, the voiced consonants are output as sound of the frequency and the volume in a range surrounded by a range 52, and the voiceless consonants are output as sound of the frequency and the volume in a range surrounded by a range 54. As illustrated in FIG. 7, the range 50 of vowels and a part of the range 52 of voiced consonants are included in the range of the sounds heard by the hearing-impaired, between the audible threshold 42 and the unpleasant threshold 44, but a part of the range 52 of voiced consonants and the whole range 54 of the voiceless consonants are not included. Therefore, it can be understood that when the sound is output as the same output as that for the person with normal hearing ability, the hearing-impaired can hear the vowels but almost nothing of the consonants (voiced consonants, voiceless consonants). Specifically, the hearing-impaired can hear a part of the voiced consonants but almost nothing of the voiceless consonants.

FIG. 8 is a diagram simply amplifying the high-pitched tones (consonants) illustrated in FIG. 7. A range 50*a* of vowels illustrated in FIG. 8 is the same as the range 50 of vowels illustrated in FIG. 7. A range 52*a* of voiced consonants is set in the direction of louder volume from the entire range 52 of voiced consonants illustrated in FIG. 7, i.e., the range 52*a* is set upward in FIG. 8 from the range 52 in FIG. 7. A range 54*a* of voiceless consonants is also set in the direction of louder volume from the entire range 54 of voiceless consonants illustrated in FIG. 7, i.e., the range 54*a* is set upward in FIG. 8 from the range 54 in FIG. 7. As illustrated in FIG. 8, when the sound in the frequency domain which is difficult to be heard is simply amplified, i.e., the sound in the range 52*a* of voiced consonants and in the rage 54*a* of voiceless consonants is simply amplified, the louder volume parts of the ranges exceed the unpleasant threshold 44, and as a result, the high-pitch sound is heard as shrieked sound. That is, the sound is heard distorted and the words cannot be heard clearly.

To address that problem, as illustrated in FIG. 9, the sound is compensated by the sound compensation unit 34 of the mobile electronic device 1 according to the embodiment; specifically, compression processing (processing of reducing the gain to loud sound below the gain to small sound) is performed on the loud sound of FIG. 8. A range 50*b* of vowels illustrated in FIG. 9 has the gain to loud sound reduced smaller than that in the range 50*a* of vowels illustrated in FIG. 8. A range 52*b* of voiced consonants has the gain to loud sound reduced smaller than that in the range 52*a* of voiced consonants illustrated in FIG. 8. A range 54*b* of voiceless consonants has the gain to loud sound reduced smaller than that in the range 54*a* of voiceless consonants illustrated in FIG. 8. As illustrated in FIG. 9, the small sound is amplified by a big gain and the loud sound is amplified by a small gain so that the range 50*b* of vowels, the range 52*b* of voiced consonants, and the range 54*b* of voiceless consonants can be included in a comfortable volume range (between the audible threshold 42 and the unpleasant threshold 44). The mobile electronic device 1 decides a compensation parameter for input sound data by taking the above described things into consideration. The compensation parameter is a parameter for compensating input sound so that the sound can be heard by the user as the sound of volume between the audible threshold 42 and the unpleasant threshold 44. The mobile electronic device 1 performs compensation by amplifying the sound by a gain according to the volume and the frequency with the decided compensation parameter by the sound compensation unit 34, and outputs it to the sound processing unit 30. Accordingly, the mobile electronic device 1 can enable the hard of hearing user to hear the sound preferably.

Figure 10:
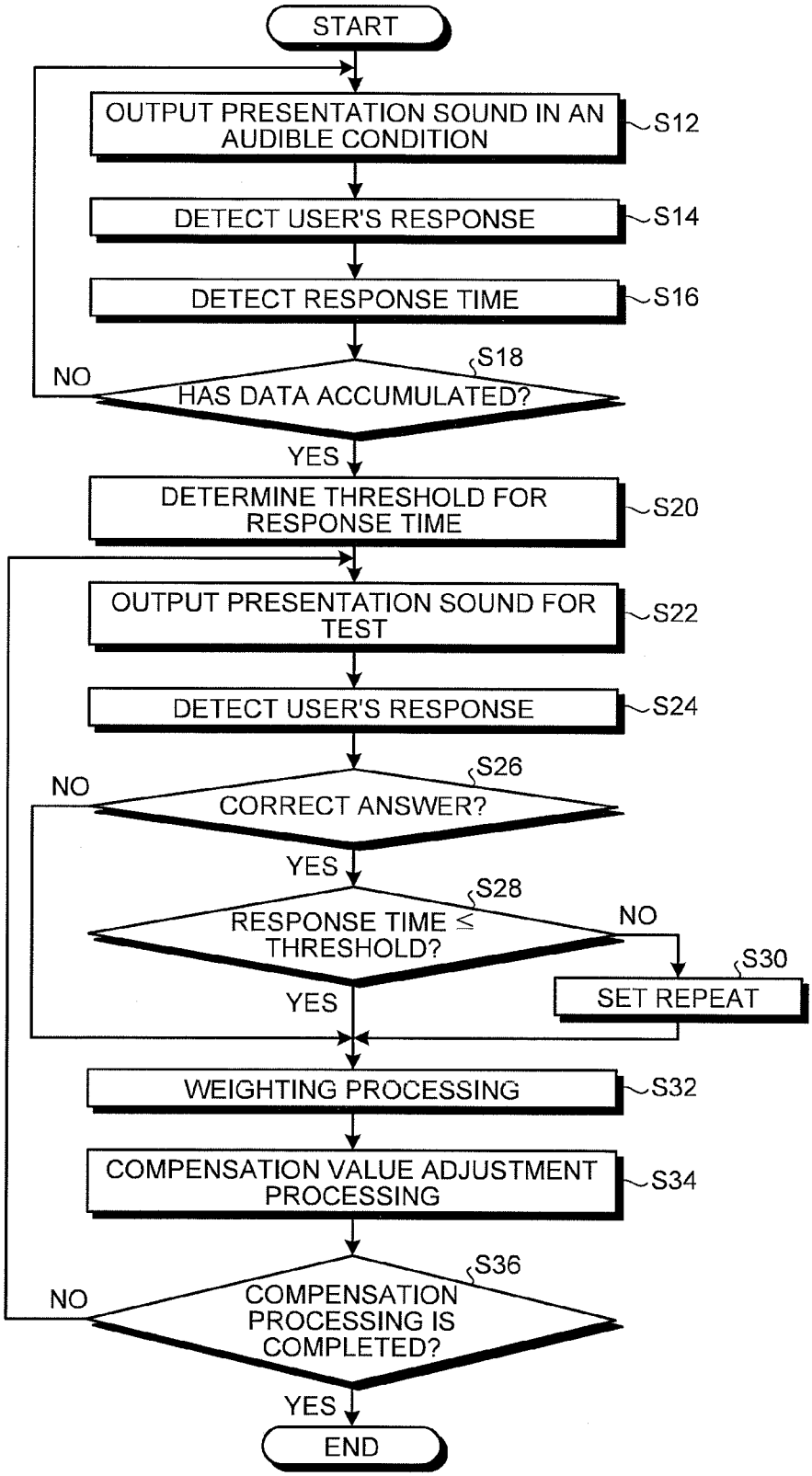
FIG. 10 is a flow chart for describing an exemplary operation of the mobile electronic device.
Figure 11:
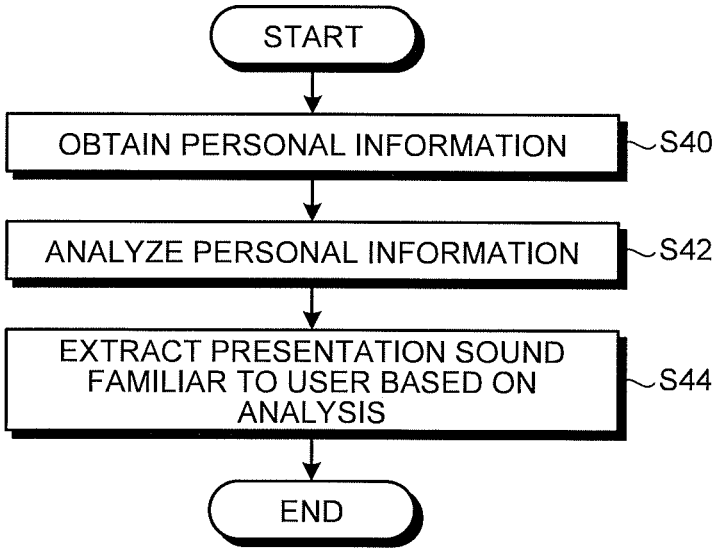
FIG. 11 is a flow chart for describing an exemplary operation of the mobile electronic device.
Figure 12:
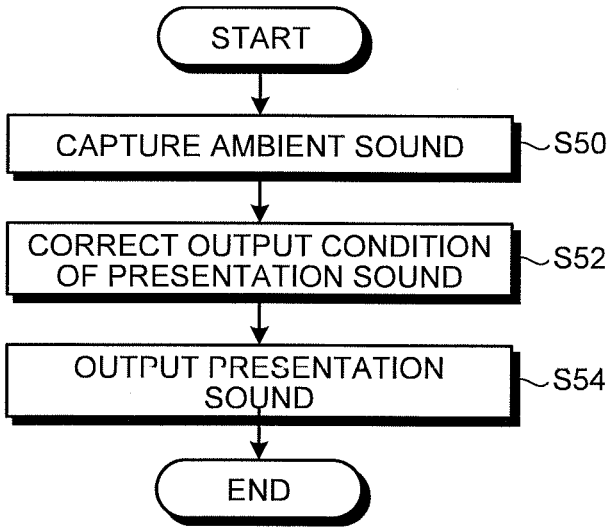
FIG. 12 is a flow chart for describing an exemplary operation of the mobile electronic device.

Then, a setting operation of a compensation parameter in the mobile electronic device will be described with reference to FIGS. 10 to 17. First, an exemplary operation of a measurement experiment performed by the mobile electronic device in setting a compensation parameter will be described with reference to FIGS. 10 to 12. FIGS. 10 to 12 are flow charts for describing an exemplary operation of the mobile electronic device, respectively. The operation described in FIGS. 10 to 12 can be realized by respective components of the processing unit 22, specifically, the parameter setting unit 22*a*, the measurement control unit 22*b*, the sound analysis unit 22*c*, the spectrum analysis unit 22*d*, the sound generation unit 22*e*, the determining unit 22*f*, and the sound correction unit 22*g* performing the respective functions. Since the operations described in FIGS. 10 to 12 are examples of measurement experiment, mainly the measurement control unit 22*b* performs respective control on the operation in cooperation with the other respective components.

The processing unit 22 outputs a presentation sound in a condition that it can be heard at Step S12. That is, in the processing unit 22, the sound generation unit 22*e* decides a presentation sound to be output among the presentation sounds in the sound data 24*c* of the storage unit 24 and outputs the presentation sound with the volume (the sound of the volume which can be heard even by user who has the low hearing ability to hear sounds) and the speed which can be heard by the user from the receiver 16 or the speaker 17 via the sound processing unit 30. The sound generation unit 22*e* of the processing unit 22 may be configured to select a word which can be easily heard as the presentation sound. When outputting the presentation sound at Step S12, the processing unit 22 starts measuring time by the timer 36.

When outputting the presentation sound at Step S12, the processing unit 22 detects a response from the user at Step S14. Before, after, or at the same time as the processing unit 22 outputs the presentation sound at Step S12, the processing unit 22 causes the display unit 32 to display an screen for inputting a response to the output presentation sound (for example, a screen with a blank text-box for inputting an answer corresponding to the presentation sound, or a screen with options for selecting an answer corresponding to the presentation sound among them). The processing unit 22 detects an operation input by the user on the operating unit 13 as the response from the user while displaying the screen for inputting the response.

When detecting the response at Step S14, the processing unit 22 detects the response time at Step S16. The response time refers to an elapsed time from the outputting of the presentation sound to the detection of the user's response. The processing unit 22 detects the response time by the determining unit 22*f* based on the time measured by the timer 36. The processing unit 22 stores the response time detected by the determining unit 22*f*, the output presentation sound, the information on an image displayed during the detection of the response and the like into the measurement result area 24*b*.

When detecting the response time at Step S16, the processing unit 22 determines whether the accumulation of data has been completed at Step S18. Specifically, the processing unit 22 determines whether the amount of accumulated data which has been obtained by the measurement control unit 22*b* performing the processing from Steps S12 to S16 satisfies a preset condition. The criterion at Step S18 may be the number of times the processing from Steps S12 to S16 is repeated, the number of times the correct response is detected at Step S14, or the like. When determining that the data has not been accumulated (No) at Step S18, the processing unit 22 proceeds to Step S12 and performs the processing from Steps S12 to S16 again. When performing the processing from Steps S12 to S16 again, the processing unit 22 may output the same presentation sound as the previous one or a different presentation sound.

When determining that the accumulation has been completed (Yes) at Step S18, the processing unit 22 decides the threshold for the response time at Step S20. Specifically, the processing unit 22 repeats the processing from Steps S12 to S16 by the determining unit 22*f* to accumulate the response times for easily heard presentation sounds in the measurement result area 24*b*, and decides the threshold for the response time based on the accumulated response times. The threshold is a criterion for determining whether the user hesitates to input the response. The determining unit 22*f* stores information on the set threshold for the response time in the measurement result area 24*b*.

When deciding the threshold at Step S20, the processing unit 22 outputs a presentation sound for test at Step S22. That is, the processing unit 22 of the mobile electronic device 1 reads the presentation sound for test from the sound data 24*c* to generate the presentation sound for test by the sound generation unit 22*e*, and outputs the sound from the receiver 16 or the speaker 17 via the sound processing unit 30. The processing unit 22 may be configured such that a word or a sentence which is likely to be misheard is used as the presentation sound for test. As the presentation sound, "A-N-ZE-N" (meaning 'safe' in Japanese), "KA-N-ZE-N" (meaning 'complete' in Japanese), or "DA-N-ZE-N" (meaning 'absolutely' in Japanese), for example, can be used. "A-N-ZE-N", "KA-N-ZE-N", and "DA-N-ZE-N" are sounds which are likely to be misheard for each other. As the presentation sound, "U-RI-A-GE" (meaning 'sales' in Japanese), "O-MI-YA-GE" (meaning 'souvenir' in Japanese), or "MO-MI-A-GE" (meaning 'sideburns' in Japanese), for example, can also be used. Other than those words, "KA-N-KYO" (meaning 'environment' in Japanese), "HA-N-KYO" (meaning 'echo' in Japanese), or "TAN-KYU" (meaning 'pursuit' in Japanese) can also be used. The processing unit 22 may be configured such that the volume barely below the set unpleasant threshold (for example, the volume slightly smaller than the unpleasant threshold) and the volume barely louder than the set audible threshold (for example, the volume slightly louder than the audible threshold) are used for the presentation sound so that the unpleasant threshold and the audible threshold can be adjusted. When outputting the presentation sound at Step S12, the processing unit 22 starts measuring time by the timer 36.

When outputting the presentation sound for test at Step S22, the processing unit 22 detects the response from the user at Step S24. Before, after, or at the same time as the processing unit 22 outputs the presentation sound at Step S22, the processing unit 22 causes the display unit 32 to display the screen for inputting a response to the output presentation sound (for example, a screen with a blank text-box for inputting an answer corresponding to the presentation sound, or a screen with options for selecting an answer corresponding to the presentation sound among them). The processing unit 22 detects an operation input by the user on the operating unit 13 as the response from the user while displaying the screen for inputting the response. When detecting the response, the processing unit 22 also detects the response time as at Step S16.

When detecting the response at Step S24, the processing unit 22 determines whether it is correct (the correct answer) at Step S26. Specifically, the processing unit 22 determines by the determining unit 22*f* whether the response detected at Step S24 is correct, i.e., whether a response of the correct answer is input or a response of an incorrect answer is input. When determining that it is correct (Yes) at Step S26, the processing unit 22 proceeds to Step S28, and when determining that it is not correct (No), i.e., that it is an incorrect answer at Step S26, the processing unit 22 proceeds to Step S32.

When it is determined Yes at Step S26, the processing unit 22 determines whether the response time is equal to or less than the threshold at Step S28. That is, the processing unit 22 determines by the determining unit 22*f* whether the response time taken for the response detected at Step S24 is equal to or less than the threshold decided at Step S20. When determining that the response time is equal to or less than the threshold (Yes) at Step S28, the processing unit 22 proceeds to Step S32.

When determining that the response time is longer than the threshold (No) at Step S28, the processing unit 22 sets a repeat of test at Step S30 and proceeds to Step S32. The repeat of test refers to a setting for outputting the presentation sound again for test.

When it is determined No at Step S26, or when it is determined Yes at Step S28, or when the processing at Step S30 is performed, the processing unit 22 performs weighting processing at Step S32. The weighting processing refers to the processing of weighting the measurement result of the presentation sound based on the response time until the response to the presentation sound for test is input, the number of times of the repeat of test (the number of retrial), or the like. The processing unit 22 of the embodiment performs the weighting processing on the measurement of the presentation sound with respect to whether the response is correct. For example, the processing unit 22 sets the percentage of correct answer to 100% in a case where the correct answer is input in the response time not longer than the threshold, and performs the weighting on the percentage of correct answer according to the proportion of the surplus time of the corresponding response time by which the response time exceeds the threshold by the determining unit 22*f*. Specifically, the processing unit 22 sets the percentage of correct answer to 90% in a case where the response time is longer than the threshold by 10%, and sets the percentage of correct answer to 80% in a case where the response time is longer than the threshold by 20%. Alternatively, when performing the weighting on the percentage of correct answer according to the number of times of the repeat of test, the processing unit 22 sets the percentage of correct answer to 90% in a case where the number of times of the repeat of test is once (i.e., in a case where the same presentation sound is used twice), and sets the percentage of correct answer to 80% in a case where the number of times of the repeat of test is twice (i.e., in a case where the same presentation sound is used for three times), and sets the percentage of correct answer to 70% in a case where the number of times of the repeat of test is three times (i.e., in a case where the same presentation sound is used for four times). When performing the weighting processing by the determining unit 22*f*, the processing unit 22 stores the processed result in the measurement result area 24*b*.

When performing the weighting processing at Step S32, the processing unit 22 performs compensation value adjustment processing at Step S34. That is, the processing unit 22 performs adjustment processing on the compensation parameter corresponding to the presentation sound by the parameter setting unit 22*a* based on the weighted result at Step S32 and the determination of correct or incorrect, and the like.

When performing the compensation value adjustment processing at Step S34, the processing unit 22 determines whether the compensation processing is completed at Step S36. Specifically, the processing unit 22 determines by the measurement control unit 22*b* whether the processing from Steps S22 to S34 satisfies a preset condition. The criterion at Step S36 may be the number of times the processing from Steps S22 to S34 is repeated, whether the repeat of test of the presentation sound which is set at Step S30 is completed, whether the presentation sound associated with compensation of the compensation parameter to be adjusted is output as the presentation sound for test and adjustment is completed, or the like. When determining that the compensation processing is not completed (No) at Step S36, the processing unit 22 proceeds to Step S22 and performs the processing from Steps S22 to S34 again. When the processing from Steps S22 to S34 is performed again, the processing unit 22 may output the presentation sound which is set for the repeat of test as the presentation sound for test or a different presentation sound as the presentation sound for test.

When determining that the compensation processing is completed (Yes) at Step S36, the processing unit 22 ends the procedure.

As illustrated in FIG. 10, the mobile electronic device 1 performs the weighting on the measurement result based on the response time and, based on the weighted result, adjusts the compensation parameter for compensating the output sound, thus setting more precisely the compensation parameter. Since a more adequate parameter can be set, the mobile electronic device 1 can perform more adequate compensation by the sound compensation unit 34 compensating the sound with the compensation parameter. Accordingly, the mobile electronic device 1 can output the sound which can be more easily heard by the user from the microphone 15 and/or the speaker 17.

The mobile electronic device 1 outputs the presentation sound and detects how the sound is heard by the user as a response. Even if the user feels difficulty in hearing the presentation sound, the user can hear the presentation sound to some extent; therefore, the user can input a response, and the response may be the correct answer by chance. If the input method of the response is a selection between two options, the answer will be correct with a probability of 50 percent even if the user cannot hear at all. For that reason, if it is determined that the presentation sound which is responded with the correct answer can be heard by the user, a compensation parameter which does not match the user's ability may be set.

To address that problem, the mobile electronic device 1 of the embodiment performs the weighting processing based on the response time. If the user cannot satisfactorily hear the presentation sound, the user hesitates to answer; therefore, the response time becomes longer than usual. Accordingly, when the detected response time is longer than the threshold, the mobile electronic device 1 uses a smaller weighting factor in spite of the correct answer because it is supposed that the user cannot normally hear the sound and hesitate to answer or that the user has no idea about the sound and inputs the answer at random. When the response time is measured to be not less than the threshold as described above, the mobile electronic device 1 can reduce the impact of a hesitatingly input response by lowering the proportion of correct answer even if the answer is correct. As described above, the mobile electronic device 1 performs the weighting by taking the response time into consideration in addition to the determination of correct or incorrect and, based on that result, sets the compensation parameter so that the compensation parameter is set by more precisely determining whether the presentation sound can be heard.

The mobile electronic device 1 calculates a determination result based on a criterion that a presentation sound more difficult to be heard takes a more response time to respond a correct answer while a presentation sound less difficult to be heard takes a less response time to respond a correct answer; therefore, the mobile electronic device 1 can determine that the presentation sound which requires longer time due to hesitating the response is a sound which is more difficult to be heard. Consequently, the compensation parameter which more precisely matches the user's ability can be set.

When the response time is longer than the threshold, the mobile electronic device 1 sets the repeat of test and outputs the sound as the presentation sound again to perform the measurement experiment for the presentation sound again so that it can more precisely determine whether the presentation sound can be heard. Consequently, the mobile electronic device 1 can distinguish a case where the user accidentally takes time to respond from a case where it is hard for the user to hear the sound in fact and the user hesitates to respond. By performing the test with the same presentation sound for a plurality of times, the mobile electronic device 1 can also distinguish a case where the user does not hear the sound in fact but makes a correct answer by chance from a case where it is hard for the user to hear the sound but the user can hear it to some extent. For example, the mobile electronic device 1 can determine that it is hard for the user to hear the sound in a case where the user successively makes the incorrect answer, and that the user cannot hear the sound in a case where the correct answer and incorrect answers are mixed. By outputting the presentation sound on the same condition in outputting it for the repeat of test, the mobile electronic device 1 can more surely perform the above described determination. By adjusting the output condition of the presentation sound as required in outputting it for the repeat of test, the mobile electronic device 1 can extract a condition to make the same presentation sound more easily heard.

By performing the weighting processing also based on the number of times the repeat of test is set as in the embodiment, the mobile electronic device 1 can determine whether it accidentally takes time or it is hard for the user to hear the sound and the user hesitates to respond every time. Consequently, the compensation parameter which more precisely matches the user's ability can be set.

The processing unit 22 may be configured to repeatedly perform the flow illustrated in FIG. 10 with the presentation sounds of various words and sentences. Accordingly, the processing unit 22 can converge the compensation parameter at the value suitable for the user and output the sound which can be more easily heard by the user.

The processing unit 22 may be configured to regularly (for example, every three months, every six months, or the like) perform the flow illustrated in FIG. 10. Accordingly, the processing unit 22 can output the sound which can be more easily heard by the user even if the user's hearing ability changes.

The mobile electronic device 1 performs the processing from Steps S12 to S18 to detect the response to the presentation sound in a condition that it can be heard and, based on the result, decide the threshold for the response time at Step S20. Thus, the mobile electronic device 1 can set the response time that is suitable for the user as the threshold. That is, the mobile electronic device 1 can set long response time as the threshold for the user who is slow in motion, and can set short response time as the threshold for the user who is fast in motion. Consequently, whether the user hesitates to input the response can be more adequately determined.

Then, an exemplary operation of selecting a presentation sound will be described with reference to FIG. 11. The processing unit 22 obtains personal information at Step S40. Specifically, the processing unit 22 reads out respective types of information which are stored by the measurement control unit 22*b* in the personal information area 24*a*. When reading out the personal information at Step S40, the processing unit 22 analyzes the personal information at Step S42. Specifically, the processing unit 22 analyzes emails, a profile (sex, interests, birthplace), a Web page access history and the like included in the personal information for the words and the tendency of words the user usually uses by the measurement control unit 22*b*.

When analyzing the personal information at Step S42, the processing unit 22 extracts a presentation sound which is familiar to the user based on the analysis at Step S44 and finishes the procedure. Specifically, the processing unit 22 extracts a familiar presentation sound from a plurality of presentation sounds included in the sound data 24*c* based on the analysis made by the measurement control unit 22*b*. Also, the processing unit 22 can decide that the other presentation sounds are not familiar to the user by extracting a familiar presentation sound. The processing unit 22 may previously classify the presentation sound stored in the sound data 24*c* by subjects and fields to determine whether the presentation sound is familiar according to the classification. The processing unit 22 may classify the presentation sounds into a plurality of groups such as what is familiar to the user, what is a little familiar to the user, what is unfamiliar to the user, what may not have been heard of by the user based on the analysis of Step S42.

The processing unit 22 uses the presentation sound which is familiar to the user as the above described presentation sound of the Step S12, and uses the presentation sound which is unfamiliar to the user as the presentation sound for test of Step S22. Consequently, the threshold can be set by the presentation sound which has a high proportion of correct answer because the user is familiar with the sound, therefore, feels easy to hear and easy to guess, whereas the presentation sound for test can be set by the presentation sound which is unfamiliar to the user. Accordingly, the probability that the user can guess the correct answer in the measurement experiment for adjusting the compensation parameter can be lowered, so that the hearing ability of the user can be more adequately detected. Consequently, the compensation parameter which more precisely matches the user's ability can be set.

The processing unit 22 may perform the weighting on the correctly answered presentation sound based on the extraction result of Step S44. Accordingly, the proportion of correct answer is lowered for the word which the user is familiar with and easy to guess, so that the compensation parameter can be adjusted by taking account of the probability that it is guessed correctly, even if the answer is correct. Consequently, the compensation parameter which more precisely matches the user's ability can be set.

Then, an exemplary operation of outputting a presentation sound will be described with reference to FIG. 12. The processing unit 22 captures an ambient sound at Step S50. That is, the processing unit 22 captures an ambient sound via the microphone 15 by the measurement control unit 22*b*. The processing unit 22 analyzes the captured ambient sound by the sound analysis unit 22*c* and the spectrum analysis unit 22*d*. Although the ambient sound is analyzed by two components of the sound analysis unit 22*c* and the spectrum analysis unit 22*d* in the embodiment, the ambient sound only needs to be analyzed; therefore, it may be analyzed by either of the sound analysis unit 22*c* and the spectrum analysis unit 22*d*. Alternatively, the sound analysis unit 22*c* and the spectrum analysis unit 22*d* may be combined into a single sound analysis unit.

When capturing and analyzes the ambient sound at Step S50, the processing unit 22 corrects the output condition of the presentation sound at Step S52. Specifically, the processing unit 22 corrects the output condition of the output sound of the presentation sound to the output condition in accordance with the ambient sound by the sound correction unit 22*g*. That is, the sound correction unit 22*g* corrects the output condition of the presentation sound based on the analysis of the ambient condition.

When correcting the output condition of the presentation sound at Step S52, the processing unit 22 outputs the presentation sound at Step S54. That is, the processing unit 22 outputs the presentation sound whose output condition is corrected by the sound correction unit 22*g* from the receiver 16 or the speaker 17.

The mobile electronic device 1 captures and analyzes the ambient sound and, based on the analysis, correct the output condition of the presentation sound by the sound correction unit 22*g*, so that the presentation sound in accordance with the ambient sound can be output in the measurement experiment environment. Although the presentation sound is heard differently depending on the ambient environment, particularly the ambient sound, the mobile electronic device 1 of the embodiment can reduce the impact of the ambient environment on the measurement experiment by correcting the output condition of the presentation sound to output, based on the ambient sound. Consequently, the compensation parameter which matches the user's ability can be set.

For example, the mobile electronic device 1 detects the output distribution of the ambient sound for each frequency, and based on that output distribution of the ambient sound for each frequency, performs the correction so as to raise (amplify) the frequency band part of the sound constituting the presentation sound, the output of which is louder than a certain level in the ambient sound. Consequently, the interference of the ambient sound with the presentation sound can be reduced to enable the presentation sound to be heard as similar sound in any environment.

Although the presentation sound is corrected based on the detected result of the ambient sound (noise) in the embodiment, the present invention is not limited thereto. The mobile electronic device 1 may perform the weighting processing on the response based on the ambient sound. For, example, the proportion of correct answer may be set higher in a case where it is answered correctly in a loud ambient sound (loud noise) than in a case where it is answered correctly in a small ambient sound (small noise). Also by performing the weighting processing on the response based on the ambient environment, impact of the ambient environment on the measurement experiment can be reduced. Consequently, the compensation parameter which matches the user's ability can be set.

Figure 13:
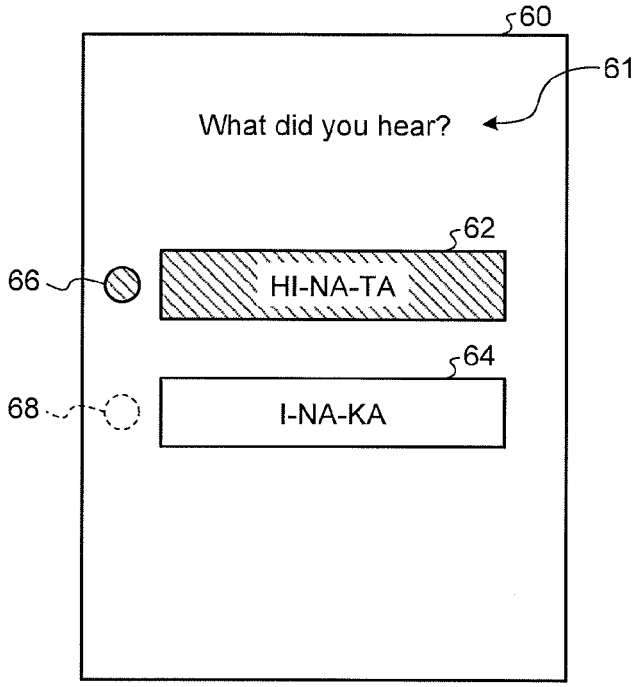
FIG. 13 is a diagram for describing an operation of the mobile electronic device.

Then, an example of an operation of detecting a response and a screen displayed for the user to input the response will be described with reference to FIG. 13. FIG. 13 is a diagram for describing an operation of the mobile electronic device. More specifically, FIG. 13 is a diagram illustrating a screen to be displayed on the display 2 in the setting operation of the compensation parameter. A case where "I-NA-KA" (meaning 'countryside' in Japanese) is output as the presentation sound will be described below.

When outputting the presentation sound, the mobile electronic device 1 causes a screen 60 illustrated in FIG. 13 to be displayed on the display unit 32. The screen 60 is a screen for inputting a heard sound and has a message 61, options 62 and 64, and a cursor 66 displayed. The message 61, which is a message for prompting the user to input (select), i.e., a message suggesting an operation to be performed by the user, is a sentence "What did you hear?" The options 62 and 64 are character strings for the user to select with respect to the presentation sound by operating the operating unit 13. In the embodiment, two options are displayed, one of which is the option of the correct answer and the other of which is the option of the incorrect answer. Specifically, the option 62 is "HI-NA-TA" (meaning 'sunny place' in Japanese) which is the option of the incorrect answer. The option 64 is "I-NA-KA" which is the option of the correct answer. The cursor 66 is an indicator indicating which option is selected, and in FIG. 13, the option 62 is being selected. When the user inputs an operation of selecting the option 64, the cursor 66 disappears and a circle is displayed as a cursor in the area indicated by dotted line 68. When the mobile electronic device 1 detects a confirmation operation (for example, pressing on the decision key) while displaying the screen 60, the mobile electronic device 1 detects the option selected by the cursor upon the input of the confirmation operation as the response.

As illustrated in FIG. 13, the mobile electronic device 1 displays the screen including the options for selecting the presentation sound on the display unit 32 and allows the user to input the selecting operation, so that the mobile electronic device 1 can detect the user's response. With an option to be selected as the response, the mobile electronic device 1 can detect the response only by allowing the user to input an option. Consequently, the user can easily input the response, which can relieve the user from inconvenience involved with the measurement experiment. Although a case where two options are displayed is illustrated in FIG. 13, the present invention is not limited thereto and may display three or more options.

In the example illustrated in FIG. 13, the user inputs the response by the operation of selecting an option; however, the present invention is not limited thereto. The mobile electronic device 1 may detect the response indicating what is heard as the presentation sound in the form of input of characters. Other examples of an operation of detecting a response and a screen displayed for the user to input the response will be described with reference to FIGS. 14 to 16.

Figure 14:
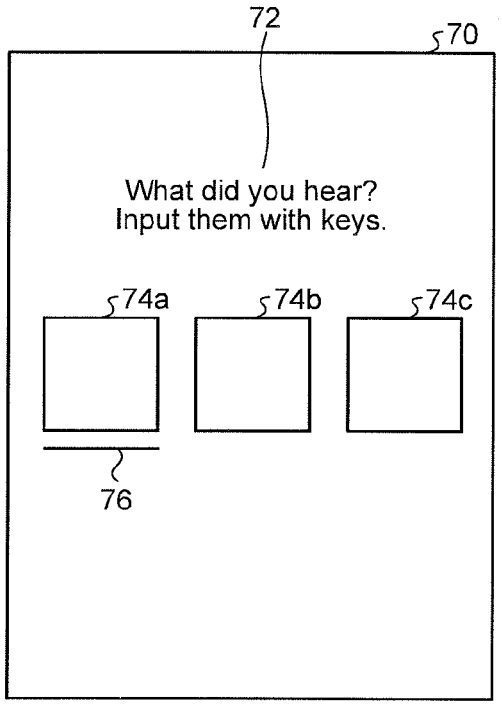
FIG. 14 is a diagram for describing an operation of the mobile electronic device.
Figure 15:
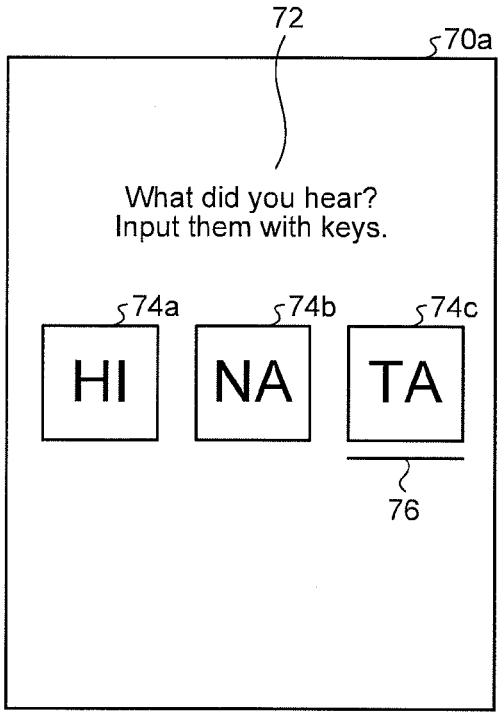
FIG. 15 is a diagram for describing an operation of the mobile electronic device.
Figure 16:
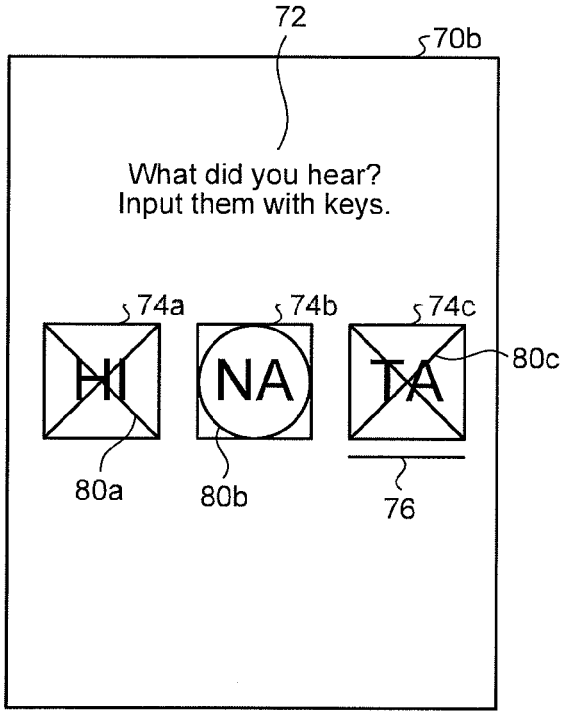
FIG. 16 is a diagram for describing an operation of the mobile electronic device.

FIGS. 14 to 16 are diagrams for describing operations of the mobile electronic device, respectively. When outputting the presentation sound, the mobile electronic device 1 causes a screen 70 illustrated in FIG. 14 to be displayed. The screen 70 is a screen for inputting a heard sound and has a message 72, input fields 74*a*, 74*b*, and 74*c*, and a cursor 76 displayed. The message 72, which is a message for prompting the user to input, i.e., a message prompting an operation to be performed by the user, is a sentence "What did you hear? Input them with keys." The input fields 74*a*, 74*b*, and 74*c* are input areas for displaying the characters input by the user operating the operating unit 13, and are displayed as input fields by the number corresponding to the number of characters of the presentation sound, i.e., three input fields corresponding to "I-NA-KA", in the embodiment. The cursor 76 is an indicator indicating which input field is to be input with a character, and in FIG. 14, the cursor 76 is displayed below the input field 74*a*.

When the operating unit 13 is operated and characters are input while the screen 70 illustrated in FIG. 14 is displayed, the mobile electronic device 1 displays the characters input in the input fields 74*a*, 74*b*, and 74*c*. On the screen 70*a* illustrated in FIG. 15, "HI-NA-TA" are input as the characters. On a screen 70*a*, "HI" is displayed in the input field 74*a*, "NA" is displayed in the input field 74*b*, and "TA" is displayed in the input field 74*c*. The cursor 76 is displayed below the input field 74*c*. When an input confirmation operation is input thereafter, the mobile electronic device 1 detects the user's response by the characters which are respectively displayed in the input fields 74*a*, 74*b*, and 74*c* upon the input of the input confirmation operation.

When "HI-NA-TA" are input as the characters as illustrated on the screen 70*a* in FIG. 15 and the input confirmation operation is input, the mobile electronic device 1 compares the characters of the presentation sound with the input characters, and causes a screen 70*b* for notifying the user whether the characters of the presentation sound agree with the characters input to be displayed as illustrated in FIG. 16. On the screen 70*b*, "HI" is displayed in the input field 74*a*, "NA" is displayed in the input field 74*b*, and "TA" is displayed in the input field 74*c*. In addition, on the screen 70*b*, a mark 80*a* indicating disagreement is superimposed on the input field 74*a*, a mark 80*b* indicating agreement is superimposed on the input field 74*b*, and a mark 80*c* indicating disagreement is superimposed on the input field 74*c*.

The mobile electronic device 1 compares the characters of the presentation sound with the response (i.e., the characters input) and, based on the comparison, sets the compensation parameter. For example, the mobile electronic device 1 analyzes "I-NA-KA" and "HI-NA-TA" into vowels and consonants and compares "INAKA" with "HINATA". Since both "INAKA" and "HINATA" have vowels "I", "A", and "A", the vowels agree with each other. To the contrary, the syllable without a consonant is misheard for that with a consonant "H", and the consonant "K" is misheard for the consonant "T". Based on the above described results, the thresholds for the objective sounds, i.e., in the embodiment, the thresholds for frequency ranges corresponding to the consonants "H", "K", "T" (the unpleasant threshold or the audible threshold) are adjusted and set. In the above described manner, the mobile electronic device 1 outputs the presentation sound and performs controlling while causing the screen displayed on the display 2, so that the compensation parameters are adjusted for each frequency range, each vowel, each voiced consonant, and each voiceless consonant.

As illustrated from FIGS. 14 to 16, since the mobile electronic device 1 detects the input characters input by the user as the response, the mobile electronic device 1 allows the user to input the heard sound as characters, so that the mobile electronic device 1 can detect the user's input surely and without an error, thus, can more precisely perform compensation on the sound.

The mobile electronic device 1 lets the user input the characters as in the embodiment while adjusting the compensation parameter, and displays the result, i.e., the result of whether the characters agree with each other on the display 2. Thus, the mobile electronic device 1 can allow the user to know that the sounds gradually become to be easily heard. Consequently, the mobile electronic device 1 can allow the user to set the compensation parameter with higher satisfaction and less stress. Also, the mobile electronic device 1 can allow the user to set the compensation parameter as though it is a video game.

Although the number of the input field for the character input is the number corresponding to the characters in the above described embodiment, the present invention is not limited thereto. For example, a screen for text input may be simply displayed.

The mobile electronic device 1 may use a word as the presentation sound, allow the user to input a heard word, and compare the words, so that the compensation processing is performed by using the language which would be really heard during a telephone communication and viewing of a television broadcast. Consequently, the mobile electronic device 1 can more adequately adjust the compensation parameter, so that a conversation via a telephone call and viewing of a television broadcast can be further facilitated.

Figure 17:
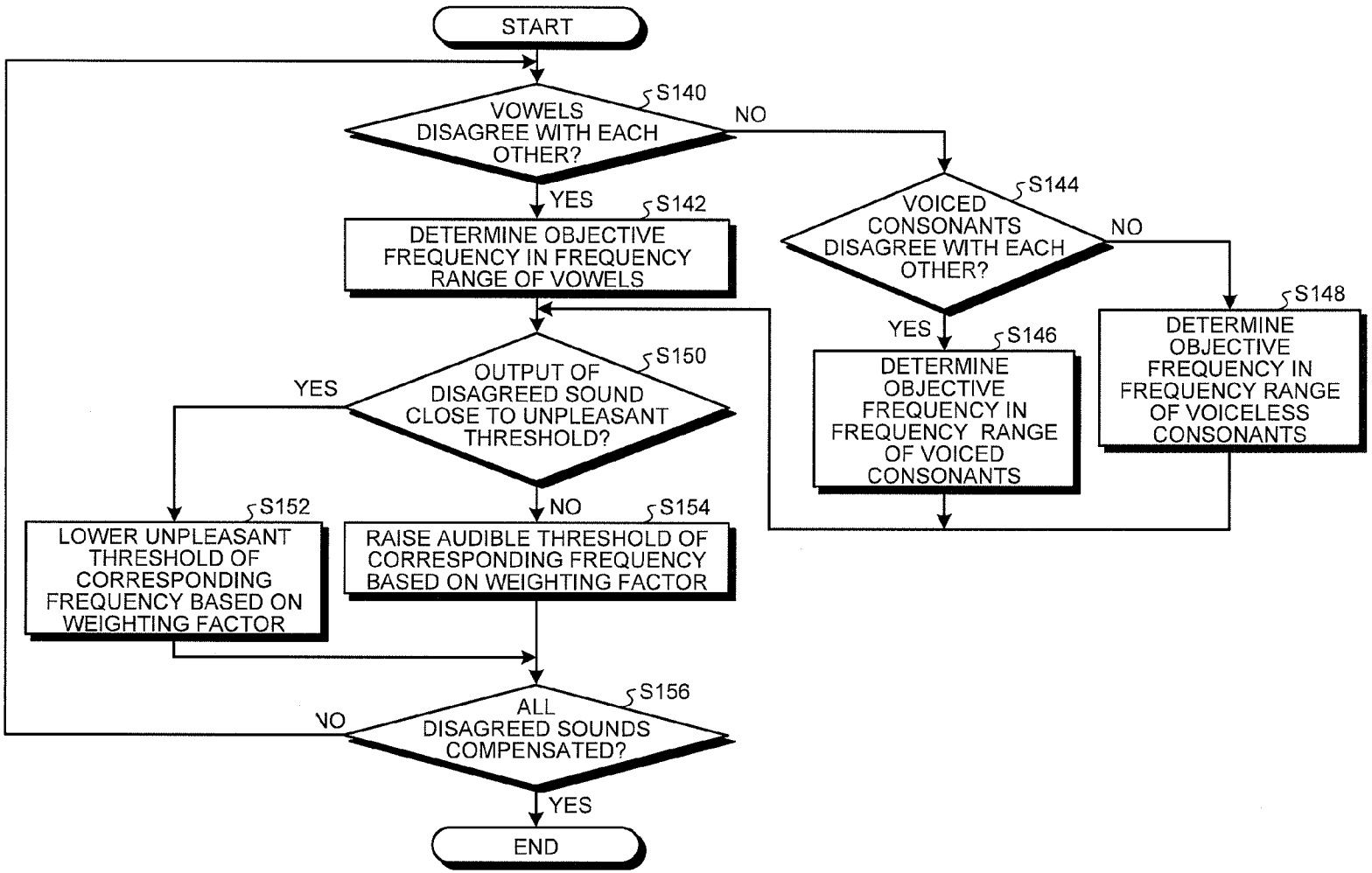
FIG. 17 is a flow chart for describing an exemplary operation of the mobile electronic device.

Then, the processing of adjusting the compensation parameter based on that the presentation sound does not agree with the input characters will be described as an example of a method for adjusting the compensation parameter with reference to FIG. 17. FIG. 17 is a flow chart for describing an exemplary operation of the mobile electronic device.

The processing unit 22 determines whether the vowels disagree with each other at Step S140. When determining that the vowels disagree with each other (Yes at Step S140) at Step S140, the processing unit 22 determines the objective frequency in the frequency range of the vowels at Step S142. That is, the processing unit 22 determines the frequency band or one or more frequencies corresponding to the disagreed vowel. When determining the frequency at Step S142, the processing unit 22 proceeds to Step S150.

When determining that the vowels do not disagree with each other (No at Step S140) at Step S140, i.e., that all the vowels agree with each other, the processing unit 22 determines whether the voiced consonants disagree with each other at Step S144. When determining that the voiced consonants disagree with each other (Yes at Step S144) at Step S144, the processing unit 22 determines the objective frequency in the frequency range of the voiced consonants at Step S146. That is, the processing unit 22 determines the frequency band or one or more frequencies corresponding to the disagreed voiced consonant. When determining the frequency at Step S146, the processing unit 22 proceeds to Step S150.

When determining that the voiced consonants do not disagree with each other (No at Step S144) at Step S144, i.e., that the disagreed sound is a voiceless consonant, the processing unit 22 determines the objective frequency in the frequency range of the voiceless consonants at Step S148. That is, the processing unit 22 determines the frequency band or one or more frequencies corresponding to the disagreed voiceless consonant. When determining the frequency at Step S148, the processing unit 22 proceeds to Step S150.

When completing the processing of Step S142, S146, or S148, the processing unit 22 determines whether the output of the disagreed sound is close to the unpleasant threshold at Step S150. That is, the processing unit 22 determines whether the output volume of the disagreed sound is close to the unpleasant threshold or to the audible threshold at Step S150; thereby, it is determined whether the cause of the mishearing is that the sound is louder than the unpleasant threshold of the user or that the sound is smaller than the audible threshold of the user.

When determining that the output of the disagreed sound is close to the unpleasant threshold (Yes at Step S150) at Step S150, i.e., that the output of the disagreed sound is close to the unpleasant threshold than to the audible threshold, the processing unit 22 lowers the unpleasant threshold of the corresponding frequency based on the weighting factor at Step S152. That is, it makes the unpleasant threshold of the frequency to be adjusted a lower value. When completing the processing of Step S152, the processing unit 22 proceeds to Step S156.

When determining that the output of the disagreed sound is not close to the unpleasant threshold (No at Step S150) at Step S150, i.e., that the output of the disagreed sound is close to the audible threshold than to the unpleasant threshold, the processing unit 22 raises the audible threshold of the corresponding frequency based on the weighting factor at Step S154. That is, the processing unit 22 makes the audible threshold of the frequency to be adjusted a higher value. When completing the processing of Step S154, the processing unit 22 proceeds to Step S156.

When completing the processing of Step S152 or S154, the processing unit 22 determines whether all the disagreed sounds have been compensated, i.e., whether the processing unit 22 has completed the compensation processing on all the disagreed sounds at Step S156. When the processing unit 22 determines that all the disagreed sounds have not been compensated (No at Step S156) at Step S156, i.e., the disagreed sound remains to be subjected to the compensation processing, the processing unit 22 proceeds to Step S140 and repeats the above described processing. Consequently, the processing unit 22 performs the compensation processing on the threshold for all the sounds that has been determined disagreed. When determining that all the disagreed sounds have been compensated (Yes at Step S156) at Step S156, the processing unit 22 ends the procedure.

The mobile electronic device 1 sets the compensation parameter for each frequency in the above described manner. When a sound signal is input, the mobile electronic device 1 compensates the sound signal based on the compensation parameter set by the sound compensation unit 34 and outputs it to the sound processing unit 30. Accordingly, the mobile electronic device 1 can compensate the sound signal by the compensation parameter which is set according to the user's hearing (how the sound is heard by the user, the user's hearing ability) and can output the sound which can be more easily heard by the user.

The processing unit 22 analyzes the presentation sound into vowels, voiced consonants, and voiceless consonants and sets the compensation parameter for each frequency corresponding to each of the vowels, voiced consonants, and voiceless consonants as in the embodiment, so that the mobile electronic device 1 can output the sound which can be more easily heard by the user.

As described above, the mobile electronic device 1 sets the compensation parameter for each frequency, analyzes the sound into vowels, voiced consonants, and voiceless consonants, and sets the compensation parameter for each frequency corresponding to each of the vowels, voiced consonants, and voiceless consonants, since the mobile electronic device 1 can set the compensation parameter more suitable for the user's ability; however, the present invention is not limited thereto. The mobile electronic device 1 can use various units for the setting standard and setting unit of the compensation parameter. Even in the case where various units are used for the setting standard and setting unit of the compensation parameter, it is possible to set the compensation parameter which matches the user's ability by weighting the detected result of the response at least based on the response time and, based on the weighting result, setting the compensation parameter.

Although the mobile electronic device 1 uses the presentation sound stored in the sound data as the presentation sound, various output method can be used for the method of outputting the presentation sound. For example, the mobile electronic device 1 may sample the sound used in a call and use it. Alternatively, the mobile electronic device 1 may set the compensation parameter also by having a specific intended party speak out prepared text information, obtaining the text information and the sound information, and having the user input character information of what the user heard while listening to the sound information. By using a specific objective sound as the presentation sound, the mobile electronic device 1 can make the specific objective sound to be more easily heard by the user, so that the mobile electronic device 1 can further facilitate the telephone call performed with the specific object. When the mobile electronic device 1 uses sound other than the prepared presentation sound as the presentation sound, the mobile electronic device 1 may analyze that presentation sound by the sound analysis unit 22*c* and the spectrum analysis unit 22*d* and detect the correct answer and the sound composition for the presentation sound to be output, so that the mobile electronic device 1 can perform adequate measurement experiment.

The processing unit 22 may set the compensation parameter correspondingly to the frequency to be practically output by the sound processing unit 30, and may more particularly set the compensation parameter correspondingly to the frequency to be used in the telephone communication. By setting the compensation parameter for the frequency to be practically used, the processing unit 22 can make the sound to be output from the mobile electronic device 1 more easily heard by the user. The compensation parameter may be set for the frequency such as that used in CELP (Code Excited Linear Prediction), EVR (Enhanced Variable Rate Codec), and AMR (Adaptive Multi-Rate).

Although the compensation parameter is set by the processing unit 22 in the embodiment, the present invention is not limited thereto. The mobile electronic device 1 may perform the respective processing by a server which can communicate with the mobile electronic device 1 via the communication unit 26. That is, the mobile electronic device 1 may perform the processing externally. In that case, the mobile electronic device 1 performs such processing as outputting of the sound sent from the server and displaying of the image, and sends operations input by the user to the server as data. By causing the server to perform such processing as arithmetic operation and setting of the compensation parameter as described above, the load to the mobile electronic device 1 can be reduced. Also, the server which communicates with the mobile electronic device 1 may previously set the compensation parameter, so that the server compensates the sound signal based on the compensation parameter. That is, a server and the mobile electronic device 1 may be combined into a single system for performing the above described processing. Consequently, since the mobile electronic device 1 can receive a sound signal compensated in advance, the mobile electronic device 1 may need not to perform the compensation processing.

The advantages are that one embodiment of the invention enables adequately compensating the sound to be output according to individual user's hearing ability to output the sound more easily heard by the user.

What is claimed is:

1. A mobile electronic device comprising:

a sound emitting unit for emitting a sound based on a sound signal;

a sound generation unit for generating a presentation sound to be emitted by the sound emitting unit;

an input unit for receiving input of a response with respect to the presentation sound emitted by the sound emitting unit;

a timer for measuring time;

a determining unit for determining a value with respect to correctness of the response;

a parameter setting unit for setting a compensation parameter for compensating the sound signal based on the value determined by the determining unit; and a compensation unit for compensating the sound signal based on the compensation parameter and supplying the compensated sound signal to the sound emitting unit, wherein the determining unit is configured to detect a response time from emission of the presentation sound to input of the response measured by the timer and to weight the value based on the response time.

2. The mobile electronic device according to claim 1 wherein the determining unit is configured to calculate the value based on a criterion that the presentation sound more difficult to be heard takes the more response time to respond a correct answer while the presentation sound less difficult to be heard takes the less response time to respond the correct answer.

3. The mobile electronic device according to claim 1 wherein the sound generation unit is configured to generate the presentation sound, for which the determining unit determines that the response time is longer than a threshold, for an indicated number of times as the presentation sound.

4. The mobile electronic device according to claim 1 wherein the sound generation unit is configured to generate the presentation sound which can be more easily heard among sounds prepared in advance, and the determining unit is configured to detect the response time by the timer and set a criterion of the weighting based on the response time.

5. The mobile electronic device according to claim 1 further comprising a storage unit for storing personal information of a user of the mobile electronic device, wherein the determining unit is configured to determine how easily the presentation sound can be heard based on the personal information and calculate the value by further weighting the result of correct or incorrect of the response based on the how easily the presentation sound can be heard.

6. The mobile electronic device according to claim 5 wherein the sound generation unit is configured to generate the presentation sound which can be easily heard as the presentation sound based on the personal information, and the determining unit is configured to detect the response time by the timer and set a criterion of the weighting based on the response time.

7. The mobile electronic device according to claim 1 further comprising:

a sound capture unit for capturing an ambient sound; and a sound analysis unit for analyzing a sound captured by the sound capture unit, wherein the determining unit is configured to determine how easily the presentation sound can be heard based on an analysis of the ambient sound analyzed by the sound analysis unit and calculate the value by further weighting the result of correct or incorrect of the response based on the how easily the presentation sound can be heard.

8. The mobile electronic device according to claim 7 further comprising a sound correction unit for correcting an output condition of the presentation sound generated by the sound generation unit based on the analysis of the ambient sound analyzed by the sound analysis unit.

9. The mobile electronic device according to claim 1 wherein the parameter setting unit is configured to set a compensation parameter for adjusting sound volume based on the value determined by the determining unit for each sound frequency, and the compensation unit is configured to compensate the sound signal based on the compensation parameter for adjusting sound volume for each sound frequency.

10. The mobile electronic device according to claim 1 further comprising a display unit for displaying an image, wherein the input unit is configured to receive input of operation, and the determining unit is configured to compare an output sound which is output from the sound emitting unit with selecting operation which is input to the input unit and calculate the value based on the comparison.

11. The mobile electronic device according to claim 9 further comprising a display unit for displaying an image, wherein the input unit is configured to receive input of operation, and the determining unit is configured to compare an output sound which is output from the sound emitting unit with an input character which is input from the input unit and calculates the value for each frequency corresponding to a sound for which the output sound does not agree with the input character.

12. The mobile electronic device according to claim 1 wherein the compensation parameter is a parameter for compensating a sound to be produced from the sound emitting unit to have volume between an unpleasant threshold and an audible threshold.

13. The mobile electronic device according to claim 12 wherein the sound generation unit is configured to generate at least either of a sound which is smaller than the unpleasant threshold and a sound which is louder than the audible threshold as the presentation sound and cause the sound emitting unit to emit the sound.

14. The mobile electronic device according to claim 1 wherein the determining unit is configured to determine the value by analyzing the sound into a vowel, a voiced consonant, and a voiceless consonant.

15. The mobile electronic device according to claim 1 further comprising:

a sound capture unit for capturing an ambient sound;

a sound analysis unit for analyzing a sound captured by the sound capture unit; and a sound correction unit for correcting an output condition of the presentation sound generated by the sound generation unit based on an analysis of the ambient sound analyzed by the sound analysis unit.

* * * * *